US005842872A

United States Patent [19]

Hosler, Sr. et al.

[11] Patent Number: 5,842,872

[45] Date of Patent: Dec. 1, 1998

[54] MODULAR RIGHT ANGLE BOARD MOUNTABLE COAXIAL CONNECTOR

[75] Inventors: Robert Craig Hosler, Sr., Marysville; Robert Leroy Fisher, Jr., Palmyra; Timothy Lee Kocher, Camp Hill; William Vito Pauza, Palmyra; Harold William Kerlin, Port Royal, all of Pa.

[73] Assignee: The Whitaker Corporation, Wilmington, Del.

[21] Appl. No.: 666,714

[22] Filed: Jun. 18, 1996

Related U.S. Application Data

[60] Provisional application No. 60/000,778 Jun. 30, 1995 and provisional application No. 60/016,431 Apr. 29, 1996.

[51] Int. Cl.[6] ..... H01R 17/12

[52] U.S. Cl. ..... 439/63; 439/891

[58] Field of Search ..... 439/63, 581, 579, 439/608, 891

[56] References Cited

U.S. PATENT DOCUMENTS

| | | | |
|---|---|---|---|
| 3,351,892 | 11/1967 | Feeser | 339/184 |
| 4,173,386 | 11/1979 | Kauffman et al. | 339/177 R |
| 4,451,107 | 5/1984 | Dola et al. | 339/143 R |
| 4,548,453 | 10/1985 | Mummey et al. | 339/17 C |
| 4,861,271 | 8/1989 | Bogar et al. | 439/63 |
| 4,892,491 | 1/1990 | Budano, II et al. | 439/582 |
| 5,011,415 | 4/1991 | Suzuki et al. | 439/63 |
| 5,078,620 | 1/1992 | Verhoeven | 439/578 |
| 5,116,245 | 5/1992 | Baker | 439/581 |
| 5,169,343 | 12/1992 | Andrews | 439/608 |
| 5,197,893 | 3/1993 | Morlion et al. | 439/101 |
| 5,330,371 | 7/1994 | Andrews | 439/579 |
| 5,334,050 | 8/1994 | Andrews | 439/579 |
| 5,344,340 | 9/1994 | Bouleau | 439/581 |
| 5,348,491 | 9/1994 | Louwagie et al. | 439/579 |
| 5,354,219 | 10/1994 | Wanjura | 439/608 |
| 5,498,838 | 3/1996 | Furman | 439/879 |
| 5,516,294 | 5/1996 | Andrews et al. | 439/63 |
| 5,516,307 | 5/1996 | Cartesse et al. | 439/581 |

FOREIGN PATENT DOCUMENTS

| | | |
|---|---|---|
| 613215 | 8/1994 | European Pat. Off. . |
| 3117320 C2 | 4/1982 | Germany . |

*Primary Examiner*—Neil Abrams
*Attorney, Agent, or Firm*—Katherine A. Nelson

[57] ABSTRACT

A right-angle coaxial electrical connector (22) mountable to a circuit board includes a housing (24) having a plurality of contact-receiving passageways (32) and at least two coaxial contacts (36, 38) disposed in the same column defining a stacked configuration. Each coaxial contact (36, 38) includes an inner terminal and an outer conductor, the inner terminal including a right angle body portion (46) extending outwardly of the housing (24) and concluding in a first connecting portion (44) adapted for mounting to the circuit board. A metal shell (64) having two interlocking halves joinable at opposed assembly faces is disposed over the outwardly extending body portion (46) of the inner terminal thereof and engageable with the outer conductor for connection to ground. In one embodiment, the inner terminal is comprised of two terminal subassemblies (40, 52). As an alternative, the connector housing (222) could be used with an intermixture of board mountable contacts (36, 38) and cable terminated contacts (235).

13 Claims, 8 Drawing Sheets

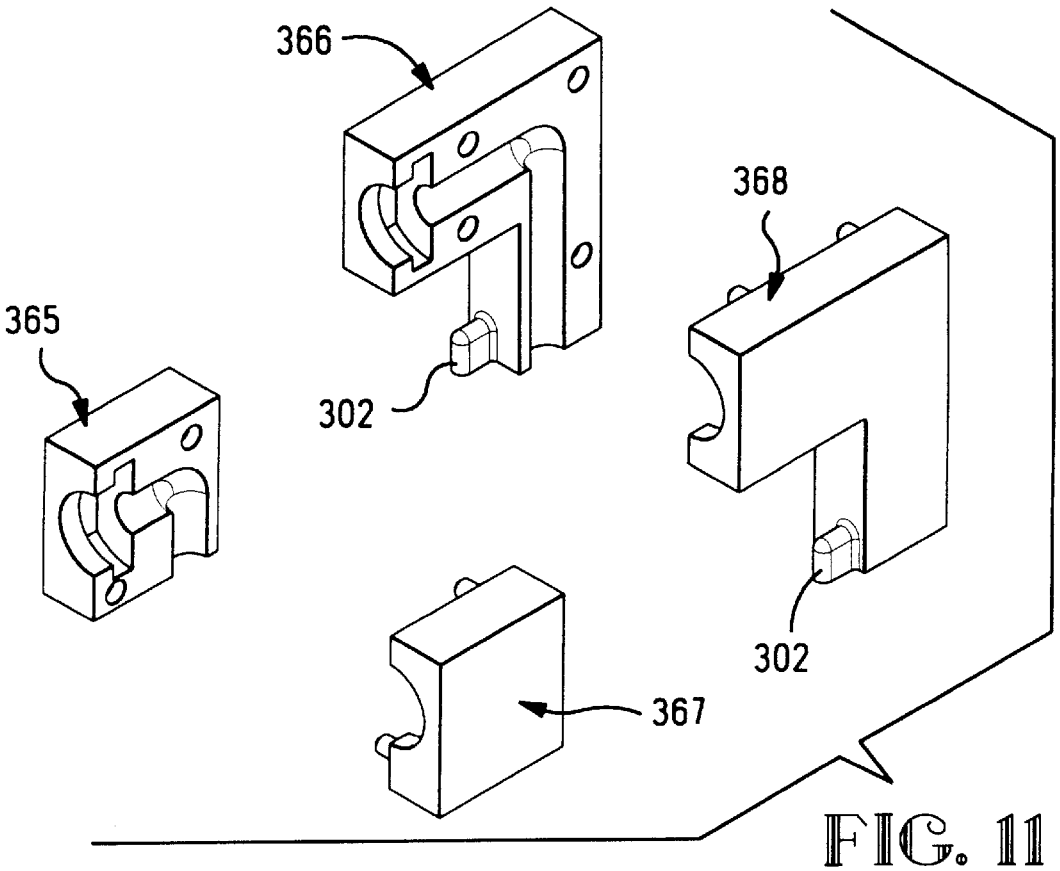
FIG. 11
FIG. 12
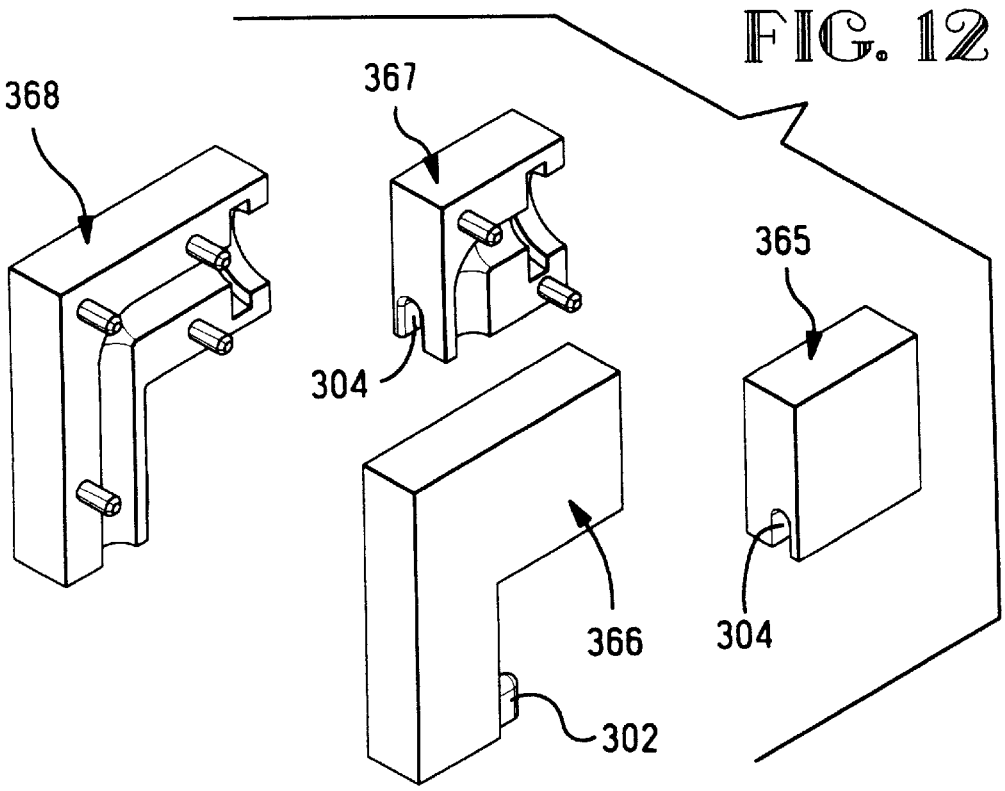

MODULAR RIGHT ANGLE BOARD MOUNTABLE COAXIAL CONNECTOR

This application claims the benefit of U.S. Provisional Application Nos. 60/000,778 filed Jun. 30, 1995 and 60/016,431 filed Apr. 29, 1996.

FIELD OF THE INVENTION

This invention relates to electrical connectors and more particularly to coaxial connectors and to right angle coaxial contact assemblies therefor.

BACKGROUND OF THE INVENTION

The use of coaxial connectors when using high frequency signals which are mountable and electrically connectable to a circuit board and are right angled to mate with receptacle on a further circuit board are known. The inner or signal contact has a generally right angled configuration with the vertical portion extending downwardly from a conductive housing to be connected to a signal path of the circuit panel and the horizontal portion extending forwardly from the front of the housing to mate with a corresponding contact of a receptacle connector.

U.S. Pat. No. 4,861,271 discloses a two row right angle coaxial plug connector which includes a plurality of right angle terminals, each having an associated conductive housing member that substantially surrounds the signal terminal and extends to the circuit board for providing interconnection to the ground circuitry thereon. The conductive housing is dimensioned to position the coaxial contact either in a lower row of contact receiving passageways of the plug housing or in an upper row passageway of the housing. When the coaxial contact is in the upper row of passageways in the housing the associated conductive housing block access to the lower row passageway in the same column. The construction of the conductive housing precludes the possibility of stacking two coaxial contacts such that one is above the other in a column. In some instances, however, it is desirable that coaxial contacts be positioned in a stacking arrangement. U.S. Pat. No. 5,169,343 discloses a coaxial connector having a plurality of coaxial contact modules, each module having stacked arrangement of two coaxial contacts. Each signal terminal is surrounded by metal walls with some of the walls being common for both signal terminals in the module.

It is also desirable in some instances to be able to use a plurality of discrete coaxial contacts interspersed with discrete signal contacts. It is desirable, therefore, to have independently shielded coaxial contacts that can be placed in upper or lower rows of contact-receiving passageways in a connector housing without blocking access to contact-receiving passageways in corresponding lower or upper rows of the same column, thereby permitting other contacts to be inserted in the upper or lower rows.

SUMMARY OF THE INVENTION

The present invention is directed to a discrete right angle coaxial contact assembly for a coaxial connector and a connector having a stacked configuration of coaxial contacts that alleviate problems associated with the prior art.

A right-angle coaxial electrical connector of the present invention having a stacked configuration of coaxial contacts includes a housing having a plurality of contact-receiving passageways disposed in at least two rows and at least one column. A coaxial contact is disposed in a lower passageway and at least one additional coaxial contact is disposed in an upper passageway. Each coaxial contact includes an inner terminal and an outer conductor disposed therearound, the inner terminal including a right angle body portion extending outwardly of the housing and concluding in a first connecting portion adapted for mounting to a circuit board. The outer conductor and a second connecting portion of the inner terminal are exposed at the mating face of the connector for electrical connection to a complementary mating coaxial connector. Each coaxial contact is surrounded by a respective metal shell disposed over the outwardly extending body portion of the inner terminal thereof and engageable with the outer conductor for connection to ground. The coaxial connector is characterized in that each metal shell comprises two interlocking halves joinable at opposed assembly faces. The assembly face of each half includes a half portion of a right angle channel, both half portions together cooperating for receiving the body portion of the inner terminal. The shell further includes at least one ground contact extending therefrom adapted to be electrically connected to a ground circuit of the circuit board.

In a preferred embodiment, the coaxial contact is an assembly that includes first and second matable terminal subassemblies, a bifurcated first metal shell and a second metal shell or outer conductor, all secured together to provide a continuous signal contact connection and a continuous ground connection. The first terminal subassembly includes a first terminal having first and second connecting portions and an intermediate right angle body portion therebetween having dielectric material disposed therearound. The first connecting portion is adapted to be mounted to a circuit board and the second connecting portion is adapted to mate with a complimentary terminal. The second subassembly includes a second terminal having first and second connecting portions and an intermediate body portion therebetween having dielectric material disposed therearound. The first connecting portion is exposed for mating to the second connecting portion of the first terminal and the second connecting portion is exposed for mating with a complimentary terminal of a mating connector.

The bifurcated first metal shell has interlocking parts joinable at opposed assembly faces and adapted to be disposed around the first terminal subassembly. The assembly face of each of the shell parts includes a half portion of a right angle channel extending therethrough from a mating face to a mounting face for receiving the body portion of the first terminal assembly and further includes a half portion of a flange receiving grove at the mating face thereof for receiving a cooperating flange of the second shell. The first shell further includes at least one ground contact extending therefrom and adapted to be electrically connected to a ground circuit of a circuit board. The second metal shell or outer conductor is a sleeve dimensioned to receive the second terminal subassembly and includes a flange adapted to be secured between the flange receiving groves of the parts of a first metal shell and form a ground connection therewith upon interlocking the first metal shell parts.

The contact is assembled by inserting the second terminal subassembly into the second shell, mating the first and second terminals and disposing the first shell parts around the first terminal subassembly and the second shell flange and interlocking the first shell parts to form a continuous ground connection between the first and second shells and a continuous signal connection between the first and second terminals.

In accordance with the invention, when the coaxial contact assembly is to be used in a bottom row of passageways in a connector housing, the first shell parts are in the form of a block. When the assembly is to be used in a cavity in an upper row of a column, the length of the legs in the right angle or L-shaped body portion of the first terminal are lengthened and the first shell parts are L-shaped to allow the shell sufficient clearance to extend over and behind a coaxial contact assembly or other contact in the lower row of the column. In the preferred embodiment the bifurcated metal first shell parts are die cast. Machine tooled parts may also be used. The dielectric material is preferably over molded around the respective terminals, as known in the art thereby facilitating the assembly of the contact. The second shell is a machined metal sleeve.

The present invention provides a means whereby coaxial contact assemblies may be placed in a stacked arrangement without blocking housing passageways that are above or below. The coaxial contact assemblies are discrete units thus allowing the user to insert them in selected passageways in a housing. This permits use of another type of contact system (i.e. signal, power) to be inserted into the lower row of passageways or to use another type of coaxial contact (i.e. cable) in the upper housing passageway. This provides added levels of adaptability not evident in the prior art.

The present invention also eliminates the need for mechanical retention mechanisms for holding the contacts within a separately molded insulating member. The present invention further eliminates the need for additional assembly processes to secure the first and second shells together since the second shell is effectively trapped within the first shell when the first shell parts are assembled.

In an alternative embodiment of the first shell, the upper and lower shells parts of paired contact assemblies are provided with inter-engageable features that prevent the respective shell halves and the assembled coaxial contact assemblies from pivoting with respect to one another and to maintain the desired alignment of the terminal connecting portions when mounting the connector assembly to a circuit board.

Embodiments of the invention will now be described by way of example with reference to the accompanying drawings.

BRIEF DESCRIPTION OF THE DRAWINGS

FIG. 11 is an exploded view of the first shell parts of the connector of FIG. 10 illustrating features on the upper shell parts.

FIG. 12 is an exploded view of the first shell parts of the connector of FIG. 10 illustrating features on the lower shell parts.

DETAILED DESCRIPTION OF THE INVENTION

Figures 1, 3:
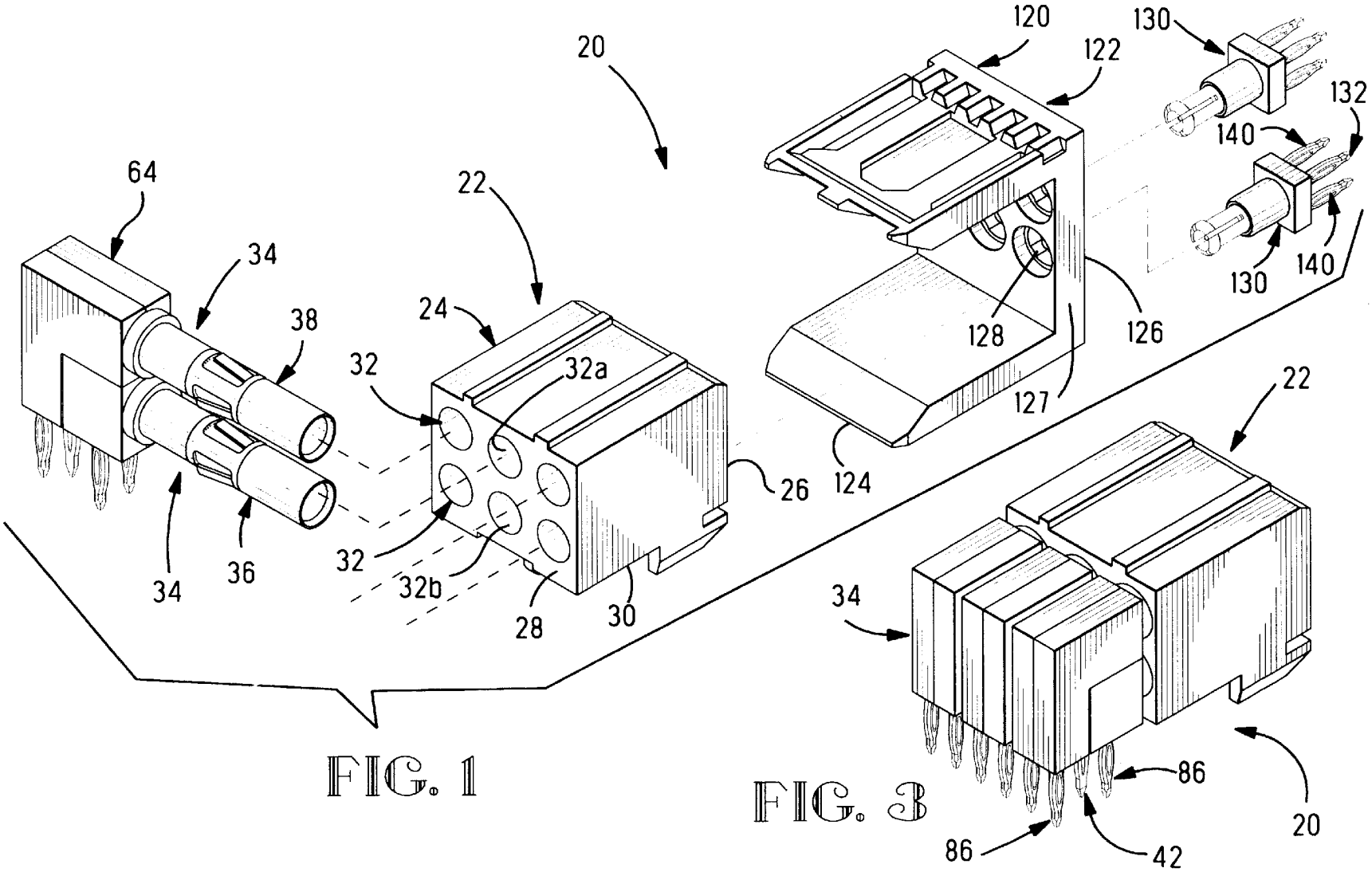
FIG. 1 is an exploded isometric view of the coaxial connector assembly of a plug and a shrouded header using the right contact coaxial assemblies of the present invention.
FIG. 3 is an isometric view of an assembled coaxial connector having the right angle coaxial contact of the present invention.
Figure 2:
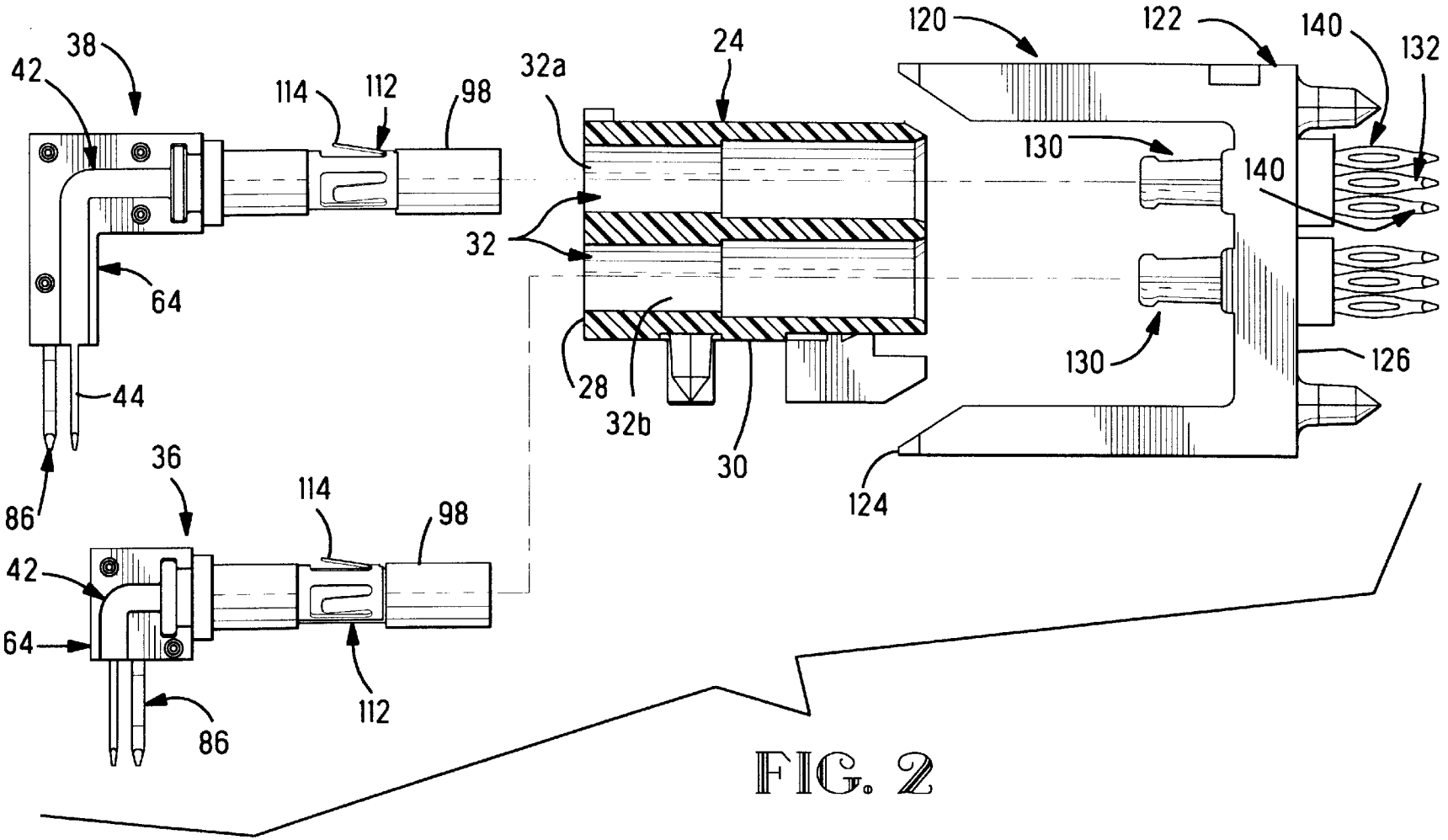
FIG. 2 is an exploded cross-sectional view of the assembly shown in FIG. 1 with the right angle coaxial contact assemblies exploded from the plug housing and an assembled header receptacle connector.

For purposes of illustrating the invention, the coaxial contact assembly will be discussed with relation to a six position connector having two rows of contract-receiving passageways. Referring now to FIGS. 1, 2, and 3, a coaxial connector assembly 20 includes a plug 22 having a plurality of stackable coaxial contact assemblies 34 matable to a receptacle or header 120 having a plurality of coaxial contacts 130. The plug connector 22 includes a housing 24 having a mating face 26 and an opposed rear or assembly face 28 and a mounting face 30. Housing 24 further includes a plurality of coaxial contact receiving passageways 32 extending between the opposed mating and rear faces 26, 28. The receptacle connector or shrouded header 120 includes a housing 122 having a mating face 124, a board mounting face 126 and a plurality of contact receiving apertures 128 extending through the floor 127 of the housing 124. Plug 22 and receptacle 120 are designed to be mounted to circuit boards (not shown).

In general, the right angle coaxial contact assembly 34 includes an inner terminal and an outer conductor disposed therearound. The inner terminal includes a right angle body portion 46 concluding in a first connecting portion 44 adapted to mounted to a circuit board, the body portion 46 having dielectric material disposed therearound. The outer conductor or shell 92 and a first connecting portion 60 of the inner terminal are adapted for mating with a complementary coaxial contact. A metal housing or shell 64 engageable with the outer conductor and to a ground circuit of a circuit board surrounds the right angle portion 46 of the inner terminal. The metal housing or shell 64 includes two interlocking halves joinable at opposed assembly faces. In the presently preferred embodiment, the inner terminal is comprised of first and second terminal subassemblies 40, 52 as described hereinafter. It is to be understood that other structures of inner terminals may be used in accordance with the invention.

As shown in FIGS. 1 through 8, the coaxial contact assemblies generally referred to as 34 have two configurations or embodiments, assemblies 36, which are dimensioned to be inserted in the lower passageways 32*b* of housing 24 and embodiments and assemblies 38, which are dimensioned to be inserted in the upper passageways 32*a* of housing 24. Embodiments 36 and 38 differ only in the dimensions and shape of the first shells and the length of the legs of the L-shaped first terminals 42. The basic structure of the embodiments 36, 38 of contact assemblies is identical and the same numbers will be used to refer to the corresponding parts of the structure of the two embodiments and discussed in general as assembly 34.

Figure 4:
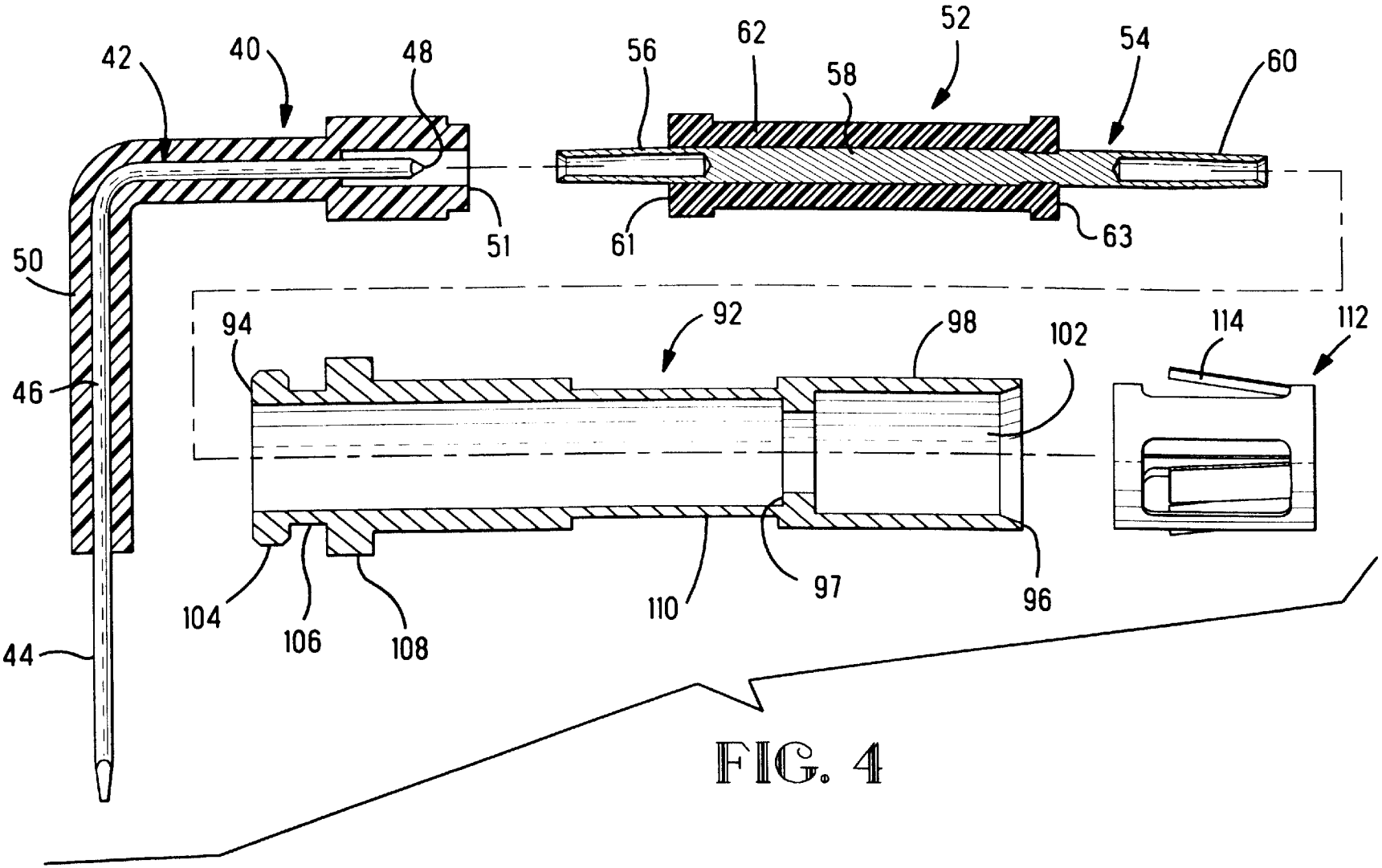
FIG. 4 is an exploded sectional view of the coaxial contact with the first shell omitted.
Figure 5:
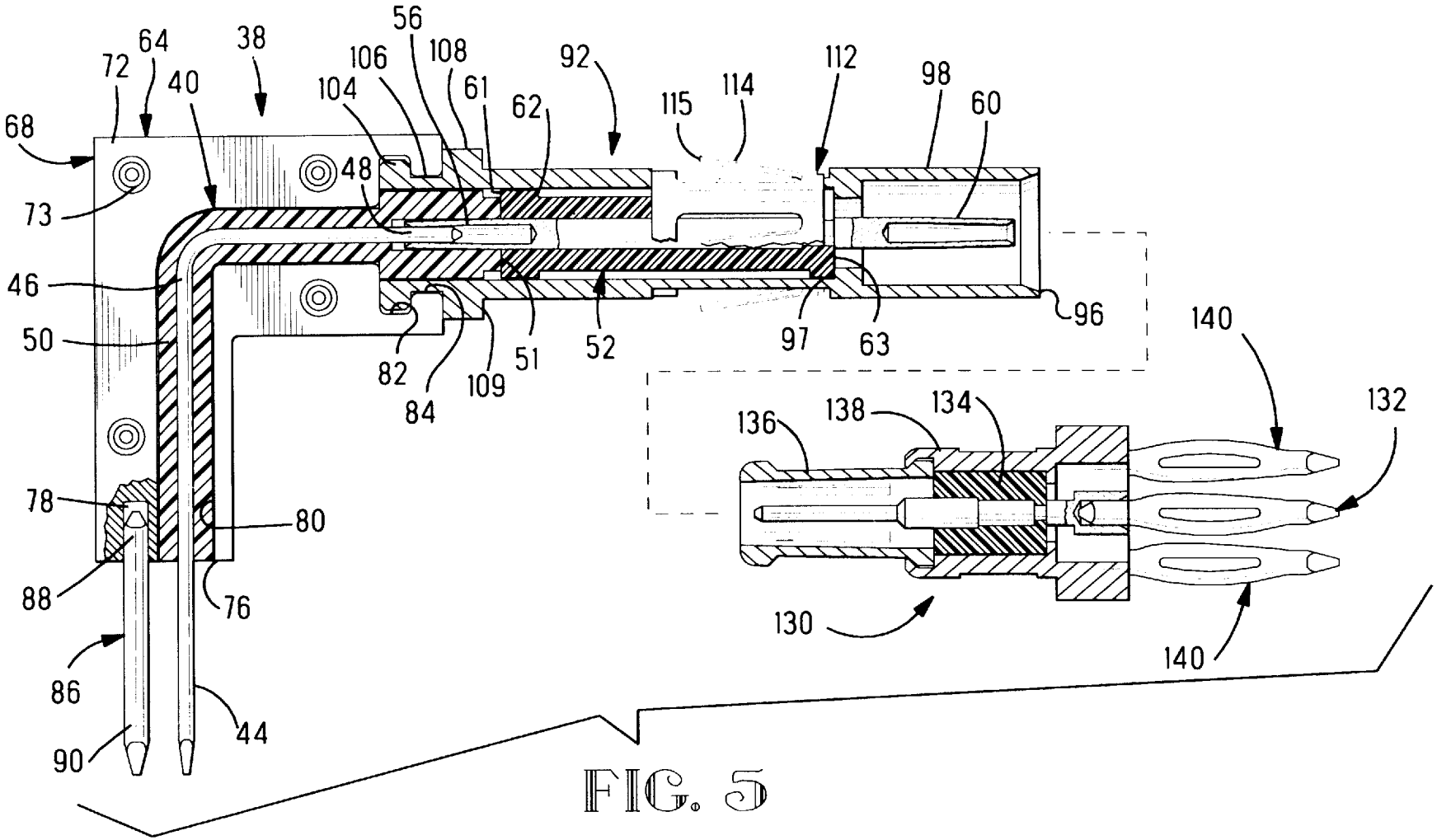
FIG. 5 is a cross-sectional view of the assembled right angle coaxial connector including the first shell and an assembled mating contact of the receptacle.
Figure 7:
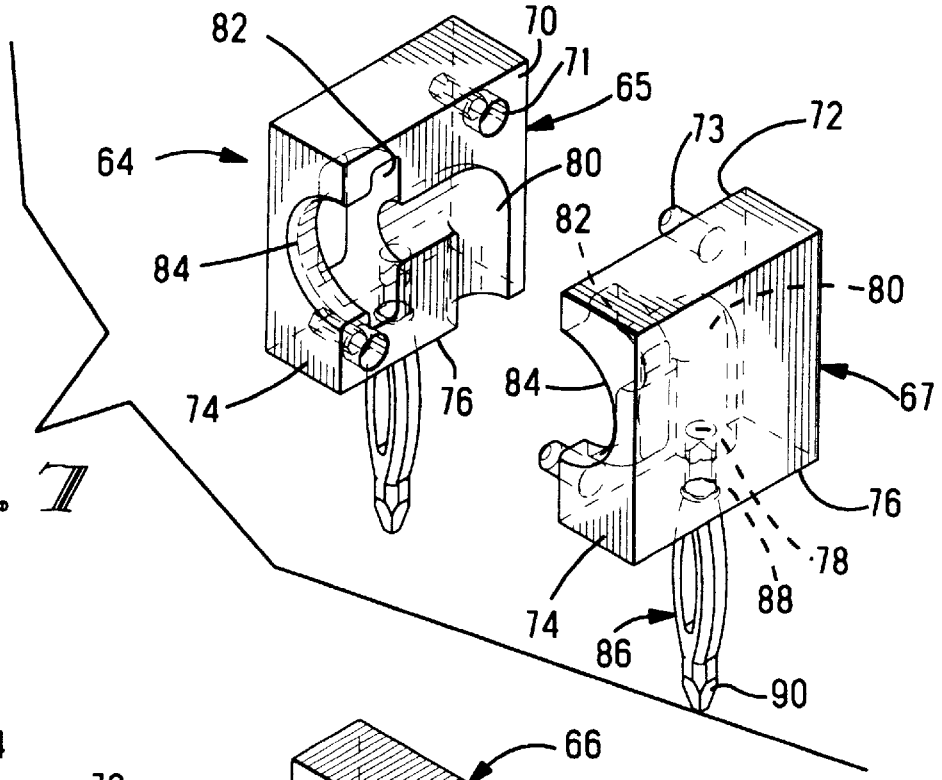
FIG. 7 is an exploded isometric view of the first shell for the lower row of contacts of the connector shown in FIG. 1.
Figure 6:
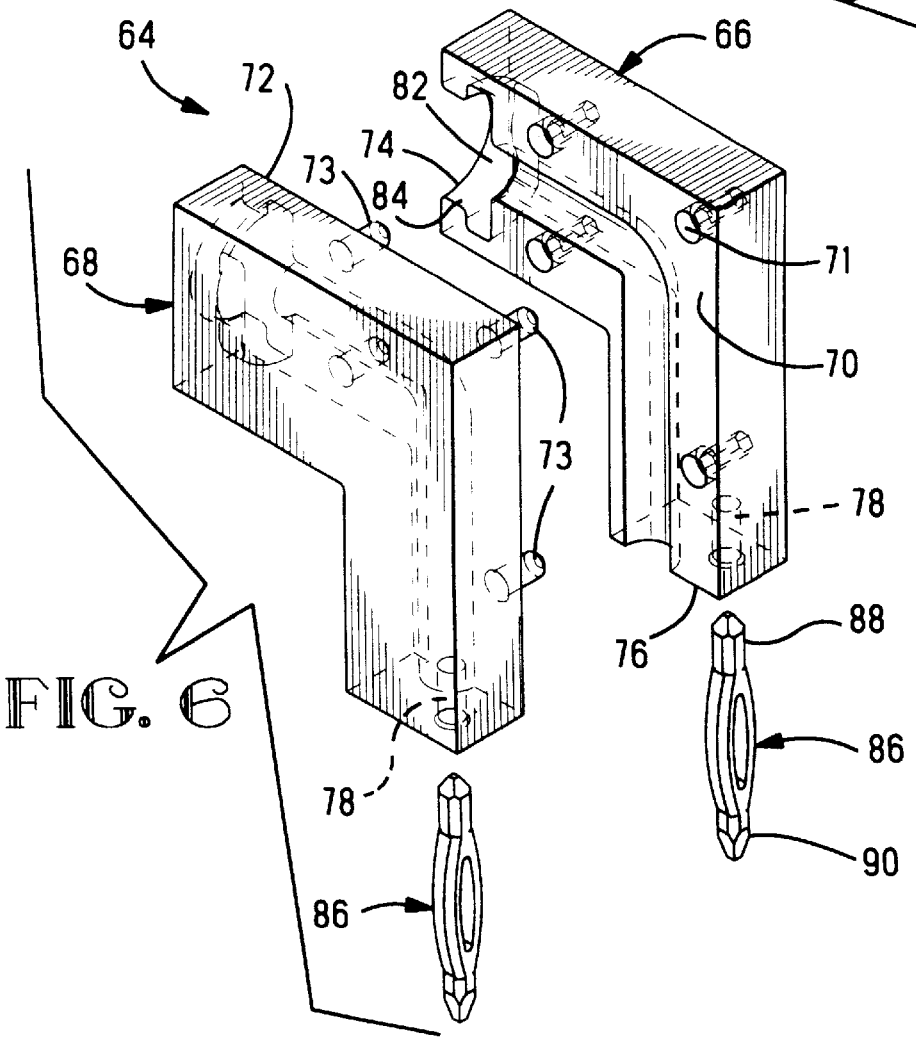
FIG. 6 is an exploded isometric view of the first shell for the upper row of contacts of the connector shown in FIG. 1.

The structure of the preferred embodiment of right angle coaxial contact assembly 34 will be best understood by referring to FIGS. 4 through 7. FIGS. 4, 5, and 6, illustrate the structure of the contact assembly 38 for use in an upper housing passageway 32*a* and FIG. 7 shows parts 65, 67 of first shell 64 for a contact assembly 36 to be used in a lower housing passageway 32*b*. For purposes of clarity, the first shell parts have been eliminated from FIG. 4.

Figure 8:
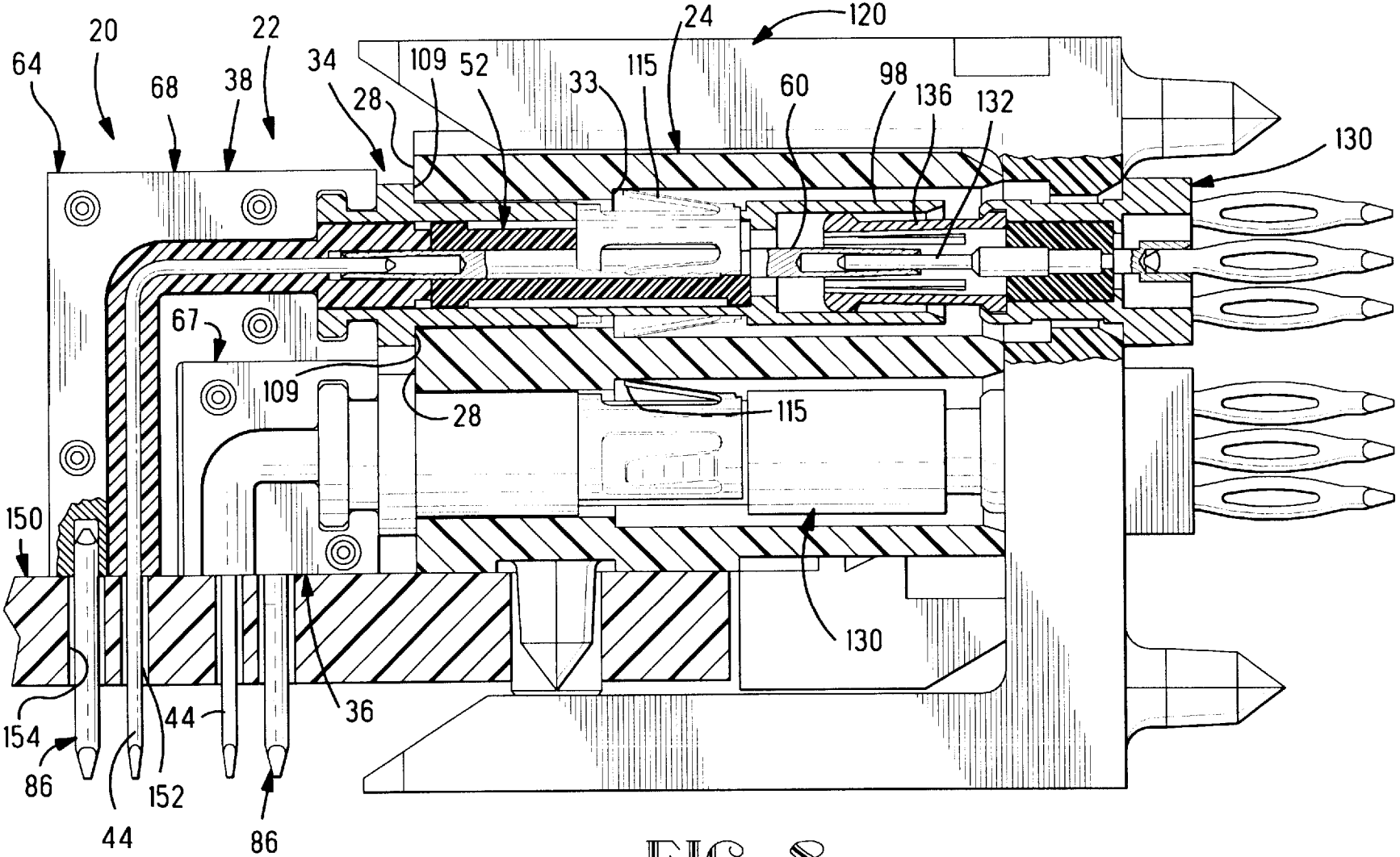
FIG. 8 is a partially sectioned side view of the mated connector assembly with the plug mounted to a circuit board and the plug and receptacle contacts mated to each other.

Referring first to FIG. 4, contact assembly 34 includes a first terminal subassembly 40, a second terminal subassembly 52 and the second shell 92. First terminal subassembly 40 includes a first terminal 42 having first and second connecting portions 44, 48 and intermediate right angle body portion 46. A dielectric material 50 is disposed around intermediate portion 46 of the first terminal 42. The first connecting portion 44 is adapted to be mounted to a circuit board 150, as shown in FIG. 8. The second connecting portion 48 is adapted to mate with complimentary terminal 54 in the second terminal assembly 52. The over molded dielectric material 50 includes a mating surface 51 at the forward end thereof approximate the second contact portion 48. In the preferred embodiment, the first terminal 42 is a right angle pin terminal and the dielectric material 50 is over molded around the right angle terminal.

The second terminal subassembly 52 includes a second terminal 54 having first and second connecting portions 56, 60 and an intermediate body portion 58. The first connecting portion 56 is exposed for mating to the second connecting portion 48 of the first terminal subassembly 40 and the second connecting portion 60 is adapted to be mated to a complementary terminal 132 in contact 130. The second terminal 54 also includes dielectric material 62 disposed therearound, preferably by overmolding, as known in the art. The dielectric portion of the second terminal subassembly 52 includes a mating surface 61 proximate the first connecting portion 56 and a stop surface 63 proximate the second connecting portion 60 of second terminal 54.

The outer conductor for second terminal 54 is a metal sleeve referred to as second shell 92, having a rear face 94, a mating face 96, and a terminal receiving passageway 102 extending therebetween. Shell 92 includes a hooded portion 98 dimensioned at the mating end thereof for receiving a complementary contact 130 and electrically engaging outer shell 136 thereof, as shown in FIG. 8. Second shell 92 includes a first flange 104 at the rear face 94 thereof, a second flange 108 spaced forwardly therefrom and a recess 106 defined therebetween. Recess 106 is adapted to receive an interlocking portion of the first shell as described hereinafter. Second shell 92 has a further recess 110 for receiving a housing retention clip 112 therearound having a plurality of compliant beams 114 adapted to for securing the coaxial contact assembly in a housing cavity 32, as shown in FIG. 8.

The structure of the first shell 64 is best understood by referring to FIGS. 6 and 7. FIG. 6 shows the bifurcated shell 64 having L-shaped halves 66 and 68 dimensioned to receive the first terminal subassembly 38 of the upper row of passageways 32*b* of contact assembly 34 as shown in FIGS. 4 and 5. The first half 66 includes an assembly face 70 having a plurality of apertures 71 and the other part 68 includes an assembly face 72 having a plurality of pins 73 adapted to be received within corresponding apertures 71 of half 66 upon assembly of the coaxial contact assembly. The halves of the shell 64 are otherwise identical and the same numbers will be used throughout.

Each of the halves includes mating face 74, mounting face 76 and an aperture 78 for receiving a ground terminal 86 extending into the mounting face 76. Each shell half further includes the half portion of a right angle channel 80 extended from the mating face 74 to mounting face 76 thereof and adapting to receive at least the right angle body portion 46 of the first terminal subassembly 40 therein. The shell halves also include a flange receiving groove 82 approximate the mating face 74 thereof. In the preferred embodiment, each shell half includes a ground contact 86 disposed in aperture 78 in mounting face 76 thereof. Ground contact 86 includes a first connecting portion 88 for being received in aperture 78 in a interference fit and a second connection portion 90 to be received in a circuit board 150, as shown in FIG. 8. In a preferred embodiment aperture 78 is round and ground contacts 86 are formed of substantially square stock such that the ground contact may be driven into respective apertures 78 of the shell mounting face 76 and be secured therein in an interference fit. The shell halves 66 and 68 are formed as right angles as previously described with the legs being sufficiently long such that the shell will extend above and behind any coaxial contact assemblies or other contacts in lower rows of the housing.

FIG. 7 shows a structure of the shell 64 having halves 65 and 67 dimensioned for a coaxial contact assembly 36 to be disposed in the lower row passageways 32*b* of the connector housing as shown in FIGS. 1, 2 and 3. The halves of this shell are identical to the upper shell halves as previously described except that the shell is substantially a block rather than being L-shaped.

In the preferred embodiment, the first terminal 42 is preferably made from phosphor bronze stock and the second terminal 54 is made from beryllium copper, or other suitable materials, as known in the art. The dielectric material for overmolding the first and second terminals is preferably a thermoplastic material having the desired dielectric constant for proper impedance matching with the overall system. One suitable material is polymethylpentene available from Mitsui Petrochemical Industries Ltd. under the trade name TPX.

Other suitable materials, as known in the art, are also suitable. In the preferred embodiment, the first shell is die cast zinc and the second shell is a sleeve that is machined from brass.

In assembling the coaxial contact assembly 34, as shown in FIGS. 4, 5 and 8, the second terminal subassembly 52 is inserted into the second shell member 92 until the leading edge 63 of the dielectric insulating material 62 engages the stop surface 97 within the shell 92. The first and second terminals 42, 54 are then mated by inserting the leading end of the dielectric material 50 of first terminal subassembly 42 into the passageway 102 of second shell 92 until second connecting portion 48 of first terminal 42 is mated with first connecting portion 56 of second terminal 54 and surfaces 51 and 61 of the respective terminal insulation 50, 62 are in engagement, as shown in FIG. 5. The resulting structure is then assembled to the first shell 64 by inserting the rearward flange 104 in groove 82 and the first terminal subassembly 40 in channel 80 of one of the halves such that the second connecting portion 44 of first terminal 42 extends from the mounting face 76 of shell part. As can be seen in FIG. 5, upon assembly of the second shell 92 and first terminal subassembly 40 into the first shell 64, the lip 84 defined by groove 82 in first shell 64 is received in the recess 106 between the forward and rearward flanges 104 and 108 of the second conductive shell 92. The second part or half 67,68 of the first shell 64 is then disposed over the remaining portions of the first terminal subassembly 40 and flange 104 and the pins 73 are engaged in the apertures 71 on the other assembly face of the other half 65,66 of first shell member 64. To assure a seal between the metal shell halves of the first shell 64 and the second and first shells 92,64 at the groove 82, conductive epoxy is disposed on the assembly face 70 prior to engaging the two halves of the first shell 64. The ground terminals 86 are then secured within their respective apertures 78 or alternatively the ground contacts 86 may be inserted in the respective shell halves prior to assembling the first shell 64 to the other parts. A housing retention clip 112 is disposed over the second shell 92 so that the coaxial contact assemblies 34 may be received into and secured within passageway 32 of housing 24.

FIG. 8 shows a stacked arrangement of coaxial contact assemblies 36 and 38 disposed in passageways 32 of housing 24. As shown therein leading surface 109 of the second flange 108 is a stop surface which engages the rear face 28 of the plug 24. The rearward extending surface 115 of the outwardly directed cantilevered beams 114 on clips 112 furthermore engage or are positioned to engage stop surface 33 within housing passageway 32 to prevent rearward movement of the coaxial contact once the contact has been assembled into the housing. FIG. 8 further shows the second connecting portions 60 of the coaxial contact assembly 34 engaged with the pin terminal 132 of contact 130 in header 120.

Figure 9:
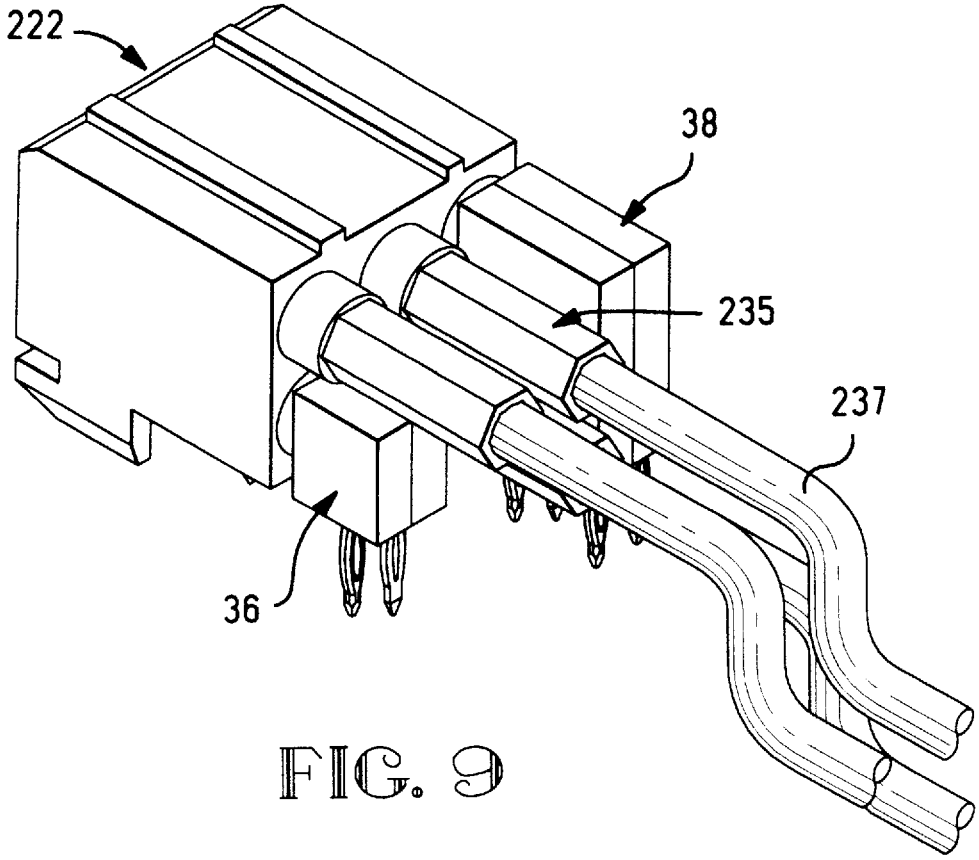
FIG. 9 is an isometric view of an assembled coaxial connector having a plurality of right angle coaxial contacts of the present invention and a plurality of coaxial cable contacts terminated to respective cables.

FIG. 9 shows a further embodiment 222 of an assembled coaxial connector that illustrates the flexibility of the coaxial contact of the present invention, wherein the connector may include an intermix of board mountable and cable terminated contacts. Connector 222 includes a plurality of right angle coaxial contacts 36, 38 made in accordance with the present invention and a plurality of coaxial cable contacts 235 each terminated to a respective cable 237.

Figure 10:
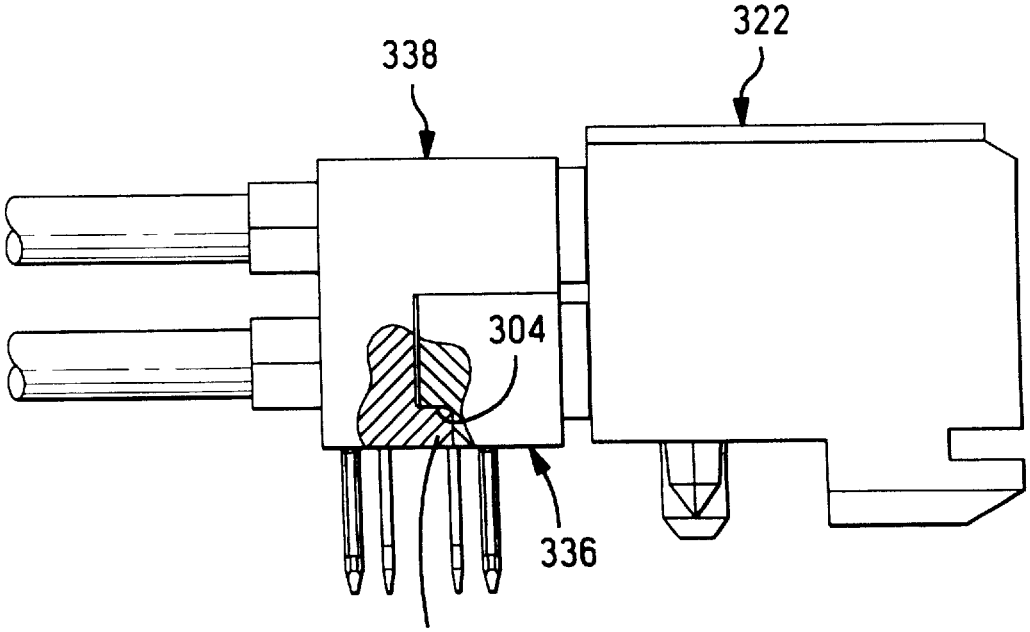
FIG. 10 is an isometric view of a further embodiment of a coaxial connector assembly having an alternative embodiment of first shell of the coaxial contact assembly.

FIGS. 10–12 illustrate an alternative embodiment 322 of an assembled coaxial connector including alternative embodiments 336,338 of the lower and upper first shells of the lower and upper coaxial contact assemblies. To prevent pivoting of the lower and upper assemblies 336,338 with respect to each other when used as a paired unit, the lower and upper shell halves 365,367; 366,368 respectively, are provided with inter-engageable features, shown as tabs or bosses 302 on the upper shell halves 366,368 and tab receiving recesses or slots 304 on the corresponding lower shell halves 365,367. The passive engageable features hold the paired assemblies in alignment with respect to one another when the coaxial contact assemblies are inserted into the respective cavities of the connector housing thereby maintaining the alignment of the respective terminal connecting portions for ease in mounting the connector assembly to a circuit board.

It is to be understood that the coaxial contact assembly 34 of the present invention can be used with connectors having more than two rows of contact receiving passageways by adjusting the dimensions of the L-shaped legs for the first terminal and first shell.

The present invention provides a discrete coaxial contact assembly that allows coaxial contacts to be stacked in a column and selectively disposed within a housing. It offers the user the chance to customize a connector design. For example, a kit of parts including a housing and a plurality contact assemblies having the desired number of appropriately dimensioned first shell members can be supplied.

The present invention offers the ease of assembly of the coaxial contact assembly. It uses a single piece right angle pin terminal and a bifurcated die cast shell that is cost effective to manufacture and assemble. It also uses dielectric overmolded contacts thus eliminating the need for mechanical retention mechanisms for holding the contacts as needed when using a separately molded insulating member. The forward and rearward flanges of the second shell effectively trap the second shell within the first shell when they are assembled, thus eliminating the need for further assembly processes.

It is thought that the coaxial contact assembly of the present invention and its many attendant advantages will be understood from the foregoing description. It is apparent that various changes may be made in the form, construction, and arrangement thereof without departing from the spirit or scope of the invention or sacrificing all of its material advantages.

We claim:

1. A right-angle coaxial electrical connector mountable to a circuit board comprising:

a housing having a mating face, an assembly face and a board mounting face, said housing including a plurality of contact-receiving passageways extending between said mating and assembly faces; and a plurality of contacts, each disposed in a respective contact-receiving passageway;

at least one of said contacts being a coaxial contact comprising:

an inner terminal and an outer conductor disposed therearound, said inner terminal including a right angle body portion extending outwardly of said housing and concluding in a first connecting portion adapted for mounting to the circuit board, said outer conductor and a second connecting portion of said inner terminal being exposed at said mating face of said connector for electrical connection to a complementary mating coaxial connector;

said coaxial contact being surrounded by a metal shell disposed over said outwardly extending body portion of said inner terminal thereof and engageable with said outer conductor for connection to ground;

said metal shell including two interlocking halves joinable at opposed assembly faces thereof, the assembly face of each half including therethrough a half portion of a right angle channel, both half portions together cooperating for receiving said body portion of said inner terminal, said shell including at least one ground contact extending therefrom adapted to be electrically connected to a ground circuit of said circuit board; and said metal shell being L-shaped having vertical and horizontal legs, the vertical leg having an extended height defining a recess forwardly thereof and beneath the horizontal leg wherein a second contact may be disposed such that the coaxial contact and the second contact may be inserted into respective contact-receiving passageways of a connector housing from said assembly face thereof, said metal shell halves being adaptable to permit the coaxial contact to be positioned in a contact-receiving passageway of a selected upper row of said connector housing without blocking access to other contact-receiving passageways therebelow.

2. The right-angle coaxial electrical connector of claim 1 wherein each half of said metal shell includes a half portion of a flange receiving groove proximate a housing engaging face thereof and said outer conductor surrounding said second connecting portion of said inner terminal includes a flange adapted to be secured between and form a ground connection with the flange receiving grooves of said halves of said metal shell upon interlocking said halves together during assembly of the coaxial contact.

3. The right-angle coaxial electrical connector of claim 1 wherein said second contact is another coaxial contact having a block-like metal shell dimensioned to be received in the recess of the L-shaped shell.

4. The right-angle coaxial electrical connector of claim 3 wherein said block-like and L-shaped shells include inter-engageable features along adjacent surfaces thereof such that said shells of the two coaxial contacts are prevented from pivoting with respect to each other.

5. The right-angle coaxial electrical connector of claim 1 wherein said plurality of contact-receiving passageways of said housing are disposed in at least two rows and at least one column and wherein one of said coaxial contacts is disposed in a lowermost passageway and at least one coaxial contact is disposed in an upper passageway in the same column defining a stacked configuration.

6. The right-angle coaxial electrical connector of claim 5 wherein said metal shell of said each of said at least one coaxial contacts in said upper row is L-shaped having vertical and horizontal legs, the vertical leg having an extended height defining a recess forwardly thereof and beneath the horizontal leg wherein said second coaxial contact may be disposed such that the stacked coaxial contacts may be inserted into respective contact-receiving passageways of a connector housing from said assembly face thereof, said L-shaped metal shell halves being adaptable to permit the coaxial contact to be positioned in a contact-receiving passageway of a selected upper row of said connector housing without blocking access to other contract-receiving passageways therebelow.

7. The right-angle coaxial electrical connector of claim 6 wherein said second coaxial contact has a block-like metal shell dimensioned to be received in the recess of the L-shaped shell.

8. The right-angle coaxial electrical connector of claim 7 wherein said block-like and L-shaped shells include inter-engageable features along adjacent surfaces thereof such that said shells of the two coaxial contacts are prevented from pivoting with respect to each other.

9. The right-angle coaxial electrical connector of claim 8 wherein said inter-engageable feature includes an outwardly extending tab on one of said shells and a complementary recess on the other of said shells.

10. The right-angle coaxial electrical connector of claim 1 wherein the inner terminal comprises first and second terminal subassemblies;

the first terminal subassembly including a first terminal having first and second connecting portions and an intermediate right angle body portion, the first connecting portion being mountable to a circuit board and the second connecting portion adapted to mate with a complementary terminal of the second terminal subassembly;

the second terminal subassembly including a second terminal having first and second connecting portions and an intermediate body portion, the first connecting portion being exposed for mating to the second connecting portion of the first terminal and the second connecting portion being exposed for mating with a complementary contact of a complementary mating coaxial connector.

11. A right angle coaxial contact assembly comprising:

an inner terminal including a right angle body portion concluding in a first connecting portion adapted to mounted to a circuit board, the body portion having dielectric material disposed therearound and a second connecting portion at an opposite end of said body portion and adapted for mating with a complementary contact;

an outer conductor surrounding at least the second connecting portion of the inner terminal and adapted to mate with a ground conductor of a mating complementary connector; and a metal shell engageable to the outer conductor and to a ground circuit of a circuit board, said metal shell comprising two interlocking halves joinable at opposed assembly faces, the assembly face of each half including therethrough a half portion of a right angle channel, both half portions together cooperating for receiving and surrounding the body portion of the inner terminal, the shell including at least one ground contact extending therefrom adapted to be electrically connected to a ground circuit of the circuit board; and said metal shell is L-shaped having vertical and horizontal legs, the vertical leg having an extended height defining a recess forwardly thereof and beneath the horizontal leg wherein a second contact may be disposed such that the coaxial contact assembly and said second contact may be inserted into respective contact-receiving passageways of a connector housing from an assembly face thereof, the L-shaped metal shell halves being adaptable to permit the coaxial contact assembly to be positioned in a contact-receiving passageway of a selected upper row of a connector housing without blocking access to other contact-receiving passageways therebelow.

12. The right angle coaxial contact assembly of claim 11 wherein each half of the metal shell includes a half portion of a flange receiving groove and the outer conductor surrounding the inner terminal includes a flange adapted to be secured between and form a ground connection with the flange receiving grooves of the halves of the metal shell upon interlocking the halves together during assembly of the coaxial contact assembly.

13. The right angle coaxial contact assembly of claim 11 wherein the inner terminal comprises first and second terminal subassemblies;

the first terminal subassembly including a first terminal having first and second connecting portions and an intermediate right angle body portion, the first connecting portion adapted to be mounted to a circuit board and the second connecting portion adapted to mate with a complementary terminal of the second terminal subassembly;

the second terminal subassembly including a second terminal having first and second connecting portions and an intermediate body portion, the first connecting portion being exposed for mating to the second connecting portion of said first terminal and the second connecting portion being exposed for mating with a complementary contact of a complementary mating coaxial connector.

* * * * *